United States Patent [19]

Lamb

[11] Patent Number: 4,506,498

[45] Date of Patent: Mar. 26, 1985

[54] TEXTILE YARN SPINNING MACHINE WITH SUPPLY STRAND INTERRUPTION

[75] Inventor: Joseph T. Lamb, Concord, Mass.

[73] Assignee: Parks-Cramer Company, Fitchburg, Mass.

[21] Appl. No.: 587,396

[22] Filed: Mar. 8, 1984

[51] Int. Cl.[3] ..... D01H 13/18

[52] U.S. Cl. ..... 57/87; 57/80; 57/86

[58] Field of Search ..... 57/78, 80, 81, 83–87

[56] References Cited

U.S. PATENT DOCUMENTS 3,726,072 4/1973 Ford et al. ..... 57/83 X
3,841,076 10/1974 Ford et al. ..... 57/83
4,000,603 1/1977 Lee, Jr. ..... 57/87
4,263,776 4/1981 Lane ..... 57/81 X
4,326,371 4/1982 Soar ..... 57/87

*Primary Examiner*—John Petrakes
*Attorney, Agent, or Firm*—Bell, Seltzer, Park & Gibson

[57] ABSTRACT

Apparatus for use in combination with a traveling unit including sensor and remote actuator means to interrupt supply strand feeding to drafting systems of a textile spinning machine. Interruption is accomplished through the cooperation of an elongate strand guide and a rotatably mounted collar including a longitudinal projection. Upon rotation of the collar, the supply strand is pinched between the collar projection and the elongate strand guide causing strand breakage.

12 Claims, 27 Drawing Figures

TEXTILE YARN SPINNING MACHINE WITH SUPPLY STRAND INTERRUPTION

FIELD AND BACKGROUND OF THE INVENTION

This invention relates generally to the textile industry, and more specifically, to the machinery used in the production of textile yarns. Textile spinning machines have long been used in the production of textile yarns, and various improvements have been added to the basic unit to obtain increases in efficiency. Included in these important developments are traveling units which simultaneously clean the machines, monitor yarn production, detect broken yarns and automatically accomplish interruption of the supply strand when a broken yarn is detected. Examples of devices of this type are shown and described in commonly owned U.S. Pat. Nos. 3,523,413, 3,659,409, 3,726,072, 3,841,076, 4,112,665, 4,263,776.

Various devices have been used in these prior systems to effect the interruption of the supply strand feeding to the drafting systems of textile yarn spinning machines. Any reader interested in disclosures of suitable supply strand interruption devices is referred, by way of example only, to a number of commonly owned prior patents: U.S. Pat. Nos. 3,832,839 to McClure, 3,841,076 to Ford et al, 4,000,603 to Lee and 4,326,371 to Soar.

Those familiar with the art will be cognizant of the great variety of spinning machines in use throughout the industry. It has heretofore been the practice to mount the strand interrupting apparatus to the "roll stand" portion of the drafting unit. Because of the variation in arrangement of the drafting units on various textile spinning machines, it has been necessary to custom design and manufacture a special mounting arrangement for the strand interrupting apparatus for each different drafting unit configuration.

SUMMARY OF THE INVENTION

One of the objects of the present invention is to provide a strand interruption apparatus which is suitable for more universal application to spinning machines of various different types and configurations. This is accomplished in accordance with the present invention by mounting the strand interrupting means between the supply package and the drafting system upon a supporting structure which is attached to the spinning machine itself, rather than to the individual roll stands.

More specifically, the textile yarn spinning machine to which the present invention pertains has a plurality of drafting units arranged in a series longitudinally of the spinning machines, and a plurality of supply strand packages, each normally deliverying a corresponding supply strand to a corresponding drafting unit for producing a corresponding attenuated strand. The system includes means which is movable along the spinning machine and which has a detector for monitoring the production of the attenuated strands and actuator means for responding to breakage of an attenuated strand. Additionally, a strand interrupting device is mounted on the spinning machine at each spinning station and is selectively remotely actuable by the actuator means for interrupting feeding of the corresponding supply strand. The improvement in accordance with the present invention comprises an elongate strand guide which is located between the supply strand packages and the drafting units and extends longitudinally past a plurality of successive drafting units. Means is associated with the elongate strand guide means and defining respective strand engaging surfaces correspondingly positioned for cooperating with the respective supply strands. The strand interrupting means additionally includes respective rotatably mounted collar means carried by the elongate strand guide, each collar means including a strand engaging surface which is adapted to cooperate with the corresponding strand engaging surface associated with the strand guide means. The collar is normally oriented in a strand feeding position with the strand engaging surface of the collar positioned in spaced apart relation from the cooperating strand engaging surface of the strand guide so that the strand is permitted to pass freely between the two strand engaging surfaces. However, the collar is freely rotatably movable to a strand interrupting position in which the cooperating strand engaging surfaces are positioned in proximate relation for interrupting feeding of the supply strand passing therebetween. Means is also provided on the collar for cooperating with the actuator means so as to effect movement of the collar means from the strand feeding position to the strand interrupting position in response to actuation by the actuator means.

In a preferred form, the elongate strand guide comprises an elongate bar which extends longitudinally of the spinning machine, and adjustable mounting means for mounting the elongate bar to the spinning machine to permit adjustment of the position of the bar both vertically and horizontally relative to the drafting units. By this arrangement, the same strand guide means can be effectively utilized on spinning machines of various different configurations. The collar is mounted for rotation about the axis of the elongate bar, and the strand engaging surface on the collar comprises a projection extending parallel to the axis of the bar. When the collar is moved from the strand feeding position to the strand interrupting position, this projection is moved into engagement with the strand so as to thereby engage and break the strand.

BRIEF DESCRIPTION OF THE DRAWINGS

Some of the features and advantages of the invention having been briefly stated, others will appear from the detailed description which follows, when taken in connection with the accompanying drawings, in which.

DETAILED DESCRIPTION OF THE ILLUSTRATED EMBODIMENTS

Figure 1:
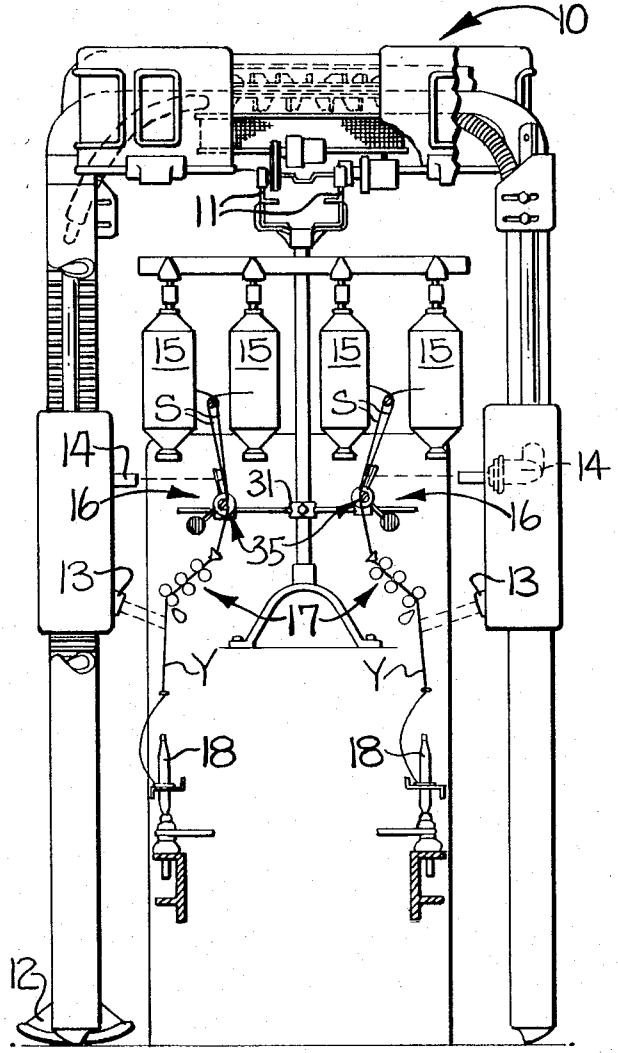
FIG. 1 is an end elevation view, partially in section and partially broken away, of a textile yarn spinning machine embodying a strand interrupting apparatus in accordance with this invention.

Referring more specifically to the drawings, and particularly to FIG. 1, a portion of a textile spinning machine is there illustrated. As is known to persons familiar with the art, a spinning machine has as its primary purpose, the production of attenuated strands of textile fibers, i.e. yarns. To this end, the spinning machine includes a series of spinning stations. At each such station, a supply strand S is directed from a supply package 15 through the strand interrupting apparatus 16. The strand is then directed to the drafting system 17. The strand, upon emergence from the drafting zone having been attenuated into a yarn Y is twisted and taken up on a bobbin 18.

Frames of the type contemplated by the invention are equipped with a traveling unit, generally indicated at 10 which moves along a track 11 extending longitudinally along the length of the spinning frame. This unit serves as a "tender", traveling along the longitudinal axis of the spinning frame, sensing the occurrence of broken yarns and interrupting the corresponding supply strands at such locations, all while simultaneously cleaning the machine and vacuuming lint fibers.

As shown, the typical spinning frame may be conceptualized as mirror image sections when divided along the longitudinal axis. In the embodiment shown, the travelling unit 10 is equipped with vacuum units 12, strand detectors 13, and strand interruption actuators 14 for operation on each side of the spinning frame. Further details of the structure and operation of the strand detectors 13 and strand interruption actuators 14 are disclosed in commonly owned U.S. Pat. No. 4,112,665 to Werst.

As previously mentioned, the typical spinning machine consists of many individual drafting stations, of which all are essentially identical in operation. In order to facilitate a clear understanding of the invention and its embodiment, the operation of only one of these drafting stations and its concomitant strand interrupting apparatus will be discussed in detail. It is to be understood that each drafting unit is equipped with a strand interrupting apparatus which is the subject matter of the instant application.

Figure 2:
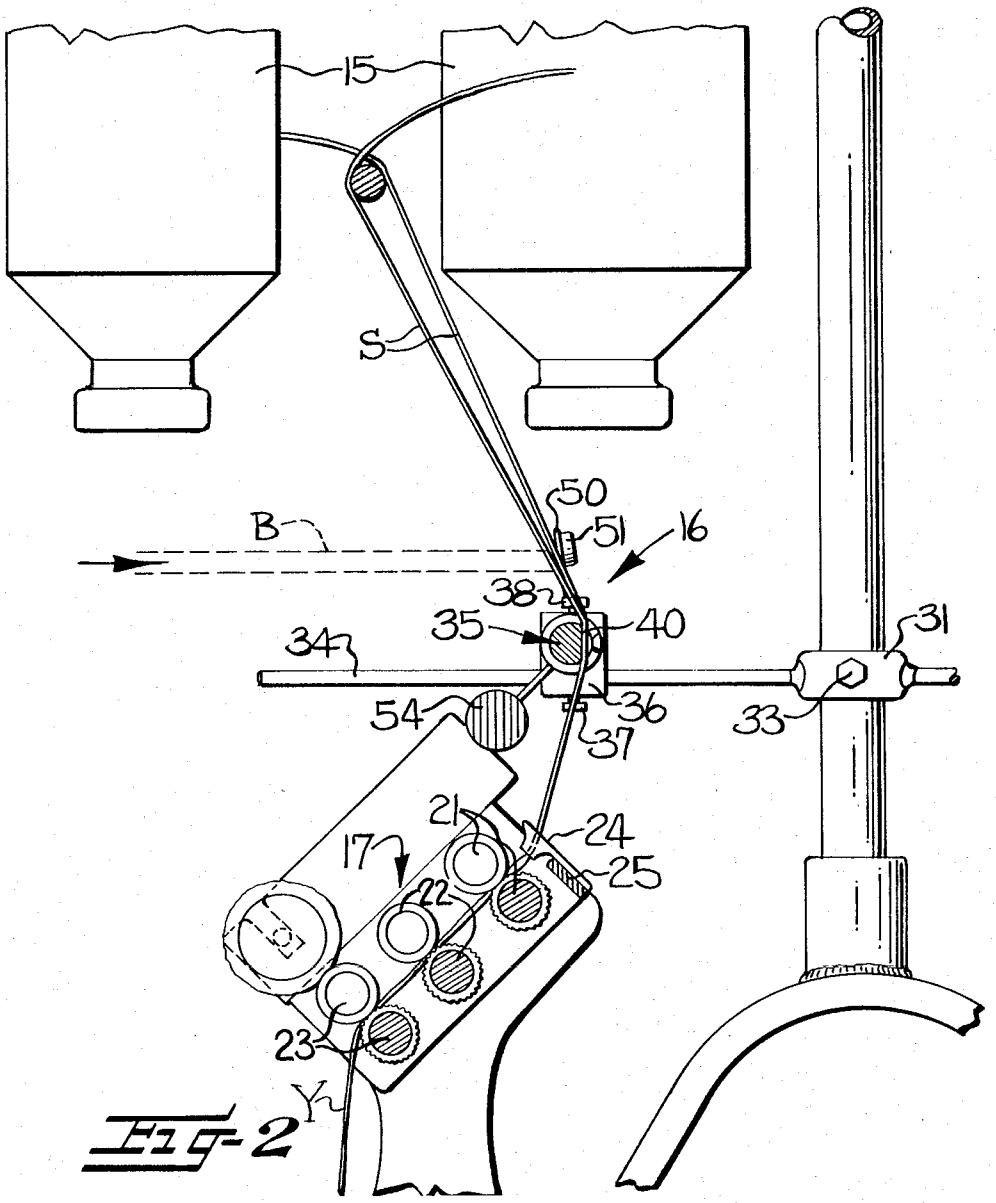
FIG. 2 is an enlarged fragmentary end elevation view of a spinning machine showing the strand interrupting apparatus located between the strand supply package and the drafting system.

The embodiment illustrated in FIG. 2 depicts the supply strand S passing through the strand interrupting apparatus 16 and then on to the drafting system, generally indicated at 17. More specifically, the drafting system 17 comprises three cooperating sets of rolls, including a set of rear rolls as generally indicated at 21, front or delivery rolls generally indicated at 23, and intermediate rolls 22. As is generally known to persons familiar with textile yarn spinning machines of the type illustrated, the series of rolls 21, 22, 23 define a series of alligned nips through which the supply strand S passes for attenuation. Adjacent the rear rolls 21 is disposed a trumpet 24 which is mounted on a traverse bar 25. The trumpet 24 receives the supply strand S and directs the supply strand into the drafting system.

When the strand detector 13 (FIG. 1) receives a broken supply strand indication, the strand interruption apparatus 16 is actuated by appropriate means, usually although not necessarily, a burst of air. The operation of the strand interruption apparatus appears later in this application in appropriate detail.

Figure 3:
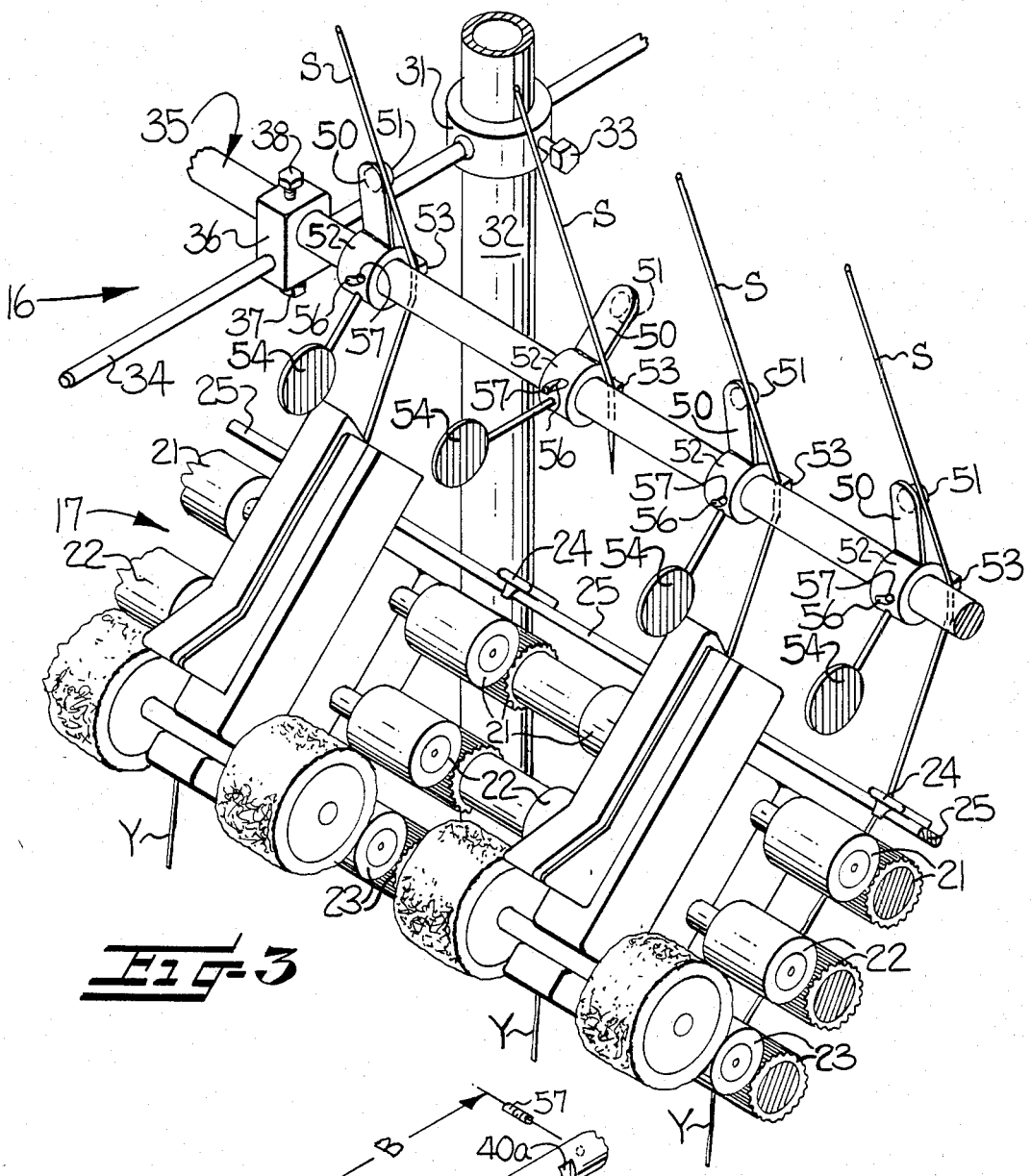
FIG. 3 is an enlarged perspective view of the portion of a textile spinning machine embodying this invention.

FIG. 3 is illustrative of the means by which the strand interruption apparatus may be easily fitted to any spinning frame currently in use or likely to be marketed at some future point in time. The prior art strand interruption devices have typically been mounted directly on the drafting system. However, as is well known to persons familiar with the art, there are in use today a variety of spinning machines, each with its own peculiar creel arrangement, drafting system configuration, gauge spacing, etc. These differences from machine to machine have necessitated the design and custom manufacture of a strand interruption mounting arrangement to fit each spinning machine variation.

The configuration contemplated by this invention is based on the concept of separating the mounting of the strand interruption apparatus from the drafting system, and hence, eliminating the necessity for customizing the apparatus to fit the particular spinning machine involved.

The strand interruption apparatus includes an elongate strand guide 35 which, as illustrated, extends longitudinally of the machine axis past a plurality of successive drafting units. The strand guide 35 is suspended a short distance above the rear of the drafting system 17 for engaging and guiding the supply strand S in its course of travel from the supply package 15 to the trumpet 24 of the drafting unit.

The adjustment means shown in FIG. 3, is an integral part of this invention, as fitting the strand interruption apparatus to any spinning frame is easily accomplished. A clamp 31 surrounds the spinning frame creel support 32 and is moved into proper position before a cooperating set screw 33 is tightened. A support rod 34 is mounted to the clamp 31 by suitable means and serves to support the elongate strand guide means 35. The rod 34 passes through a mounting block 36 with a cooperating set screw 37 as well as the elongate strand guide means 35 and cooperating set screw 38, permitting both vertical and horizontal adjustment of the apparatus relative to the spinning machine. This arrangement enables the strand interruption apparatus to be properly interposed between the supply package and the drafting system in complete independence of the pecularities of the particular machine being fitted.

Figure 4:
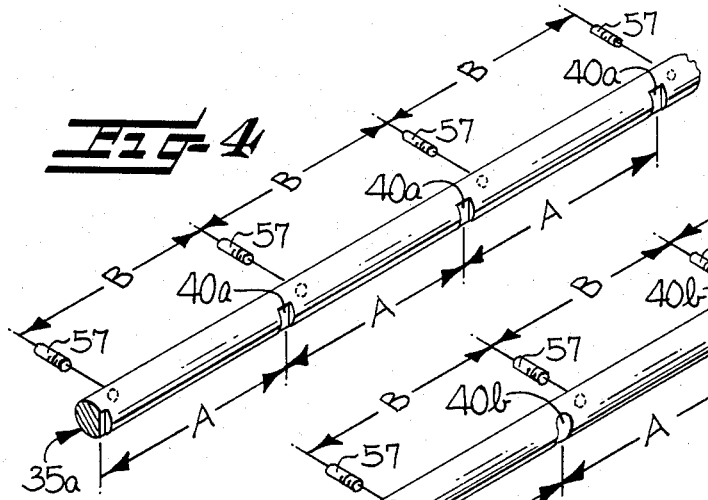
FIG. 4 is a perspective view of an elongate strand guide containing cutout portions in accordance with one embodiment of the invention.
Figure 5:
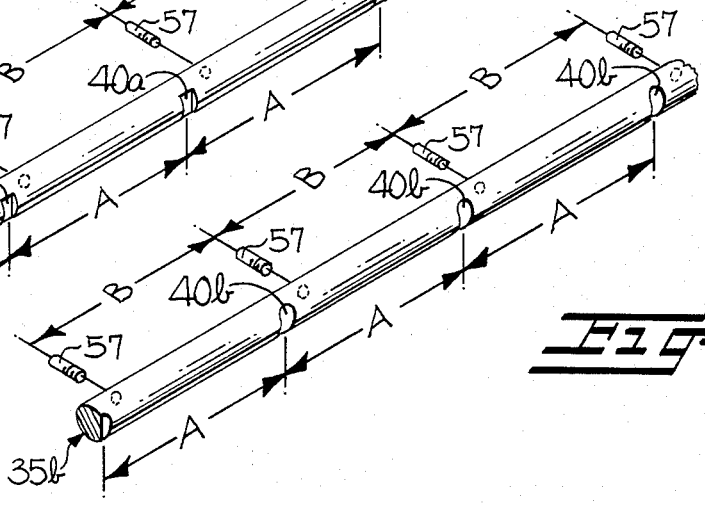
FIG. 5 is a perspective view of the elongate strand guide containing hollowed-out portions in accordance with another embodiment of this invention.

FIGS. 4 and 5 illustrate the elongate strand guide 35. It is contemplated that the strand guide may be fabricated out of metal, such as bar stock or metal tubing, or from other suitable materials, such as plastic. The elongate strand guides shown include slots 40*a* (FIG. 4), or hollows 40*b* (FIG. 5), through which the strand S flows during normal operation. The strand engaging surface of the elongate strand guide could also be formed via other suitable means, such as a bore through the strand guide. Such slots or hollows will be spaced at intervals A along the length of the longitudinal axis of the strand guide, generally corresponding to the spacing of the drafting units. It is to be understood that no particular strand guide length is contemplated by the invention, and that the physical dimensions of the structure will be dictated by the particular spinning frame being fitted, relevant factors including but not limited to the distance between individual units, the diameter of the feed strand, and the size and arrangement of the creels. Also shown are set screws or pins 57 used for positioning and/or fastening other portions of the strand interrupting apparatus to the elongate strand guide. As discussed, the set screws will be generally equally spaced, location being dictated by the above mentioned factors.

Referring more specifically to FIGS. 6–9, depicting one embodiment of said strand interrupting apparatus, the detailed operation of the strand interrupting apparatus will now be discussed. When the aforementioned traveling unit 10 and its accompanying strand detector 13 (see FIG. 1) receives an indication that an attenuated strand or yarn Y is broken, it becomes necessary to interrupt the supply strand S in order to avoid both supply strand waste and perhaps more important, damage to the drafting unit. This interrupting is obtained by activation of the strand interrupting apparatus.

The strand interruption apparatus shown in FIGS. 6–9 consists of a collar 52 (best depicted in FIG. 9) mounted for rotation about the elongate strand guide means 35. The collar includes a target 50, flag 54, and an arcoid slot 56 of depth equal to the collar thickness. Located in the aforementioned slot is a pin 57, suitably attached to the elongate strand guide and which serves to position the collar 52 and limit its arc of rotation about the elongate strand guide between the strand feeding and strand interrupting positions.

Located substantially opposite said slot is a projection 53 extending parallel to and radially offset from the axis of rotation of the collar means of thickness equal to that of the collar and of width approximating one half that of the collar.

During normal operation, supply strand S travels freely between the strand engaging surfaces of the apparatus, namely the underside of projection 53 (or a portion thereof) and the portion of the outer surface of the elongate strand guide 35 that intersects the outer edge of hollow 40.

Figure 6:
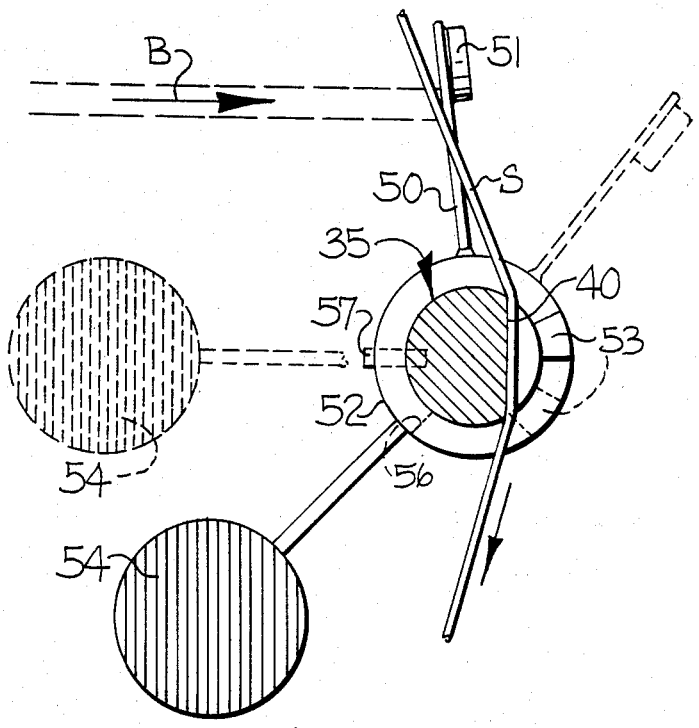
FIG. 6 is an end view of one embodiment of a strand interrupting apparatus in accordance with the invention depicting the strand feeding and strand interrupting positions.
Figure 7:
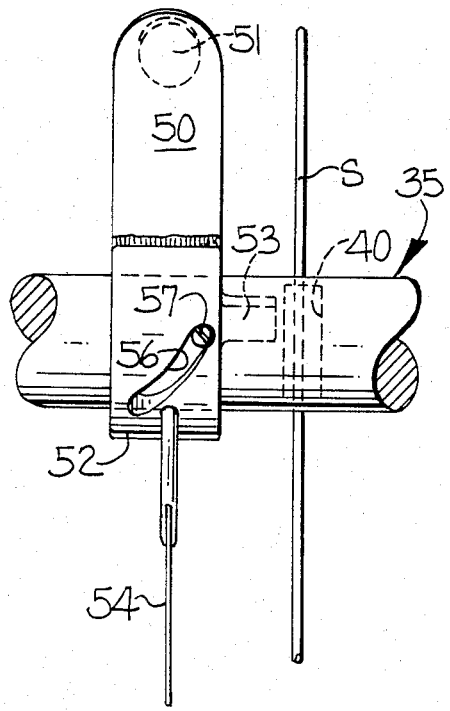
FIG. 7 is a front elevational view of the strand interrupting apparatus of FIG. 6 in the strand feeding position.
Figure 8:
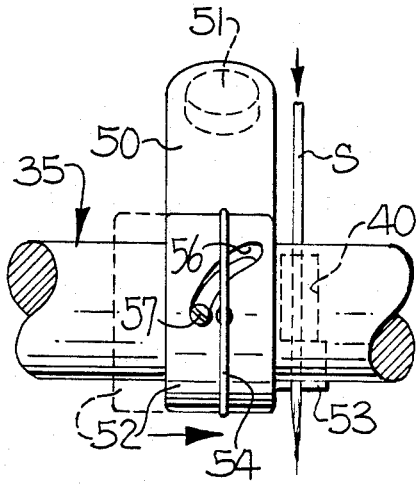
FIG. 8 is a front elevational view similar to FIG. 7, but in the strand interrupting position.
Figure 9:
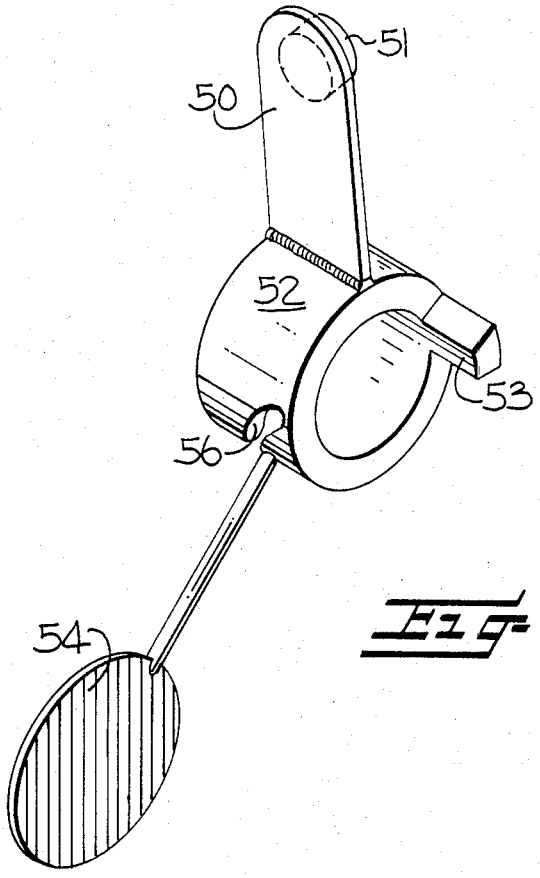
FIG. 9 is an enlarged perspective view of the movable collar portion of the strand interrupting apparatus.
Figure 10:
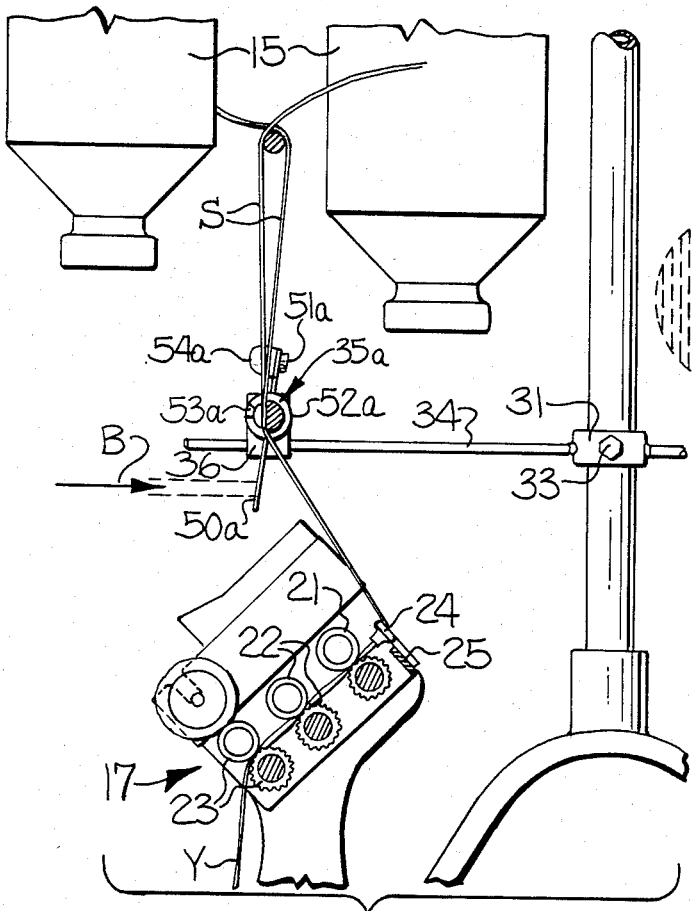
FIG. 10 is an end elevational view of a textile machine equipped with a strand interrupting apparatus in accordance with a second form of the invention.
Figure 11:
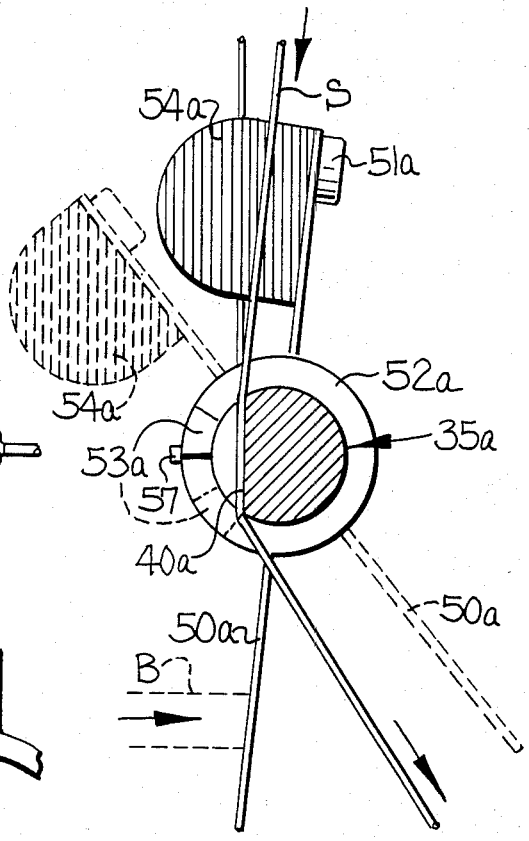
FIG. 11 is an enlarged side view of the strand interrupting apparatus of FIG. 10 depicting the strand feeding and strand interrupting positions.
Figure 12:
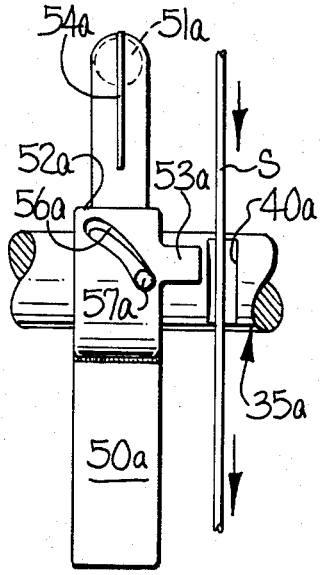
FIGS. 12 and 13 are front elevational views of the strand interrupting apparatus of FIG. 10, shown in the strand feeding and strand interrupting positions, respectively.
Figure 13:
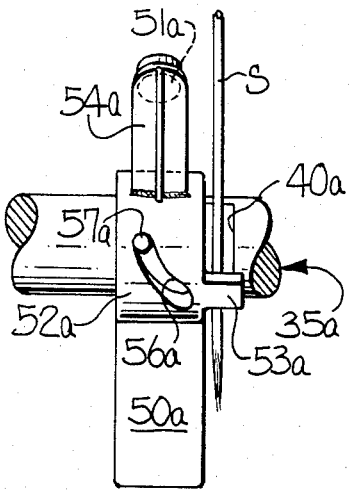
Figure 14:
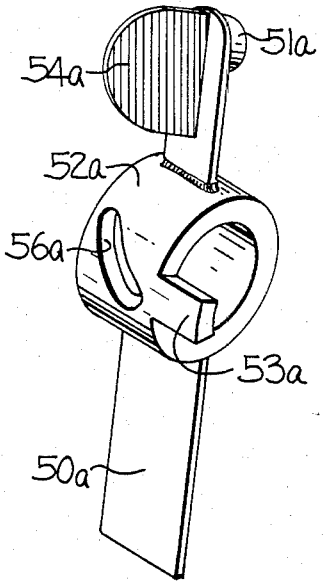
FIG. 14 is an enlarged perspective view of the movable collar portion of the strand interrupting apparatus in accordance with the embodiment of the invention shown in FIG. 10.
Figure 15:
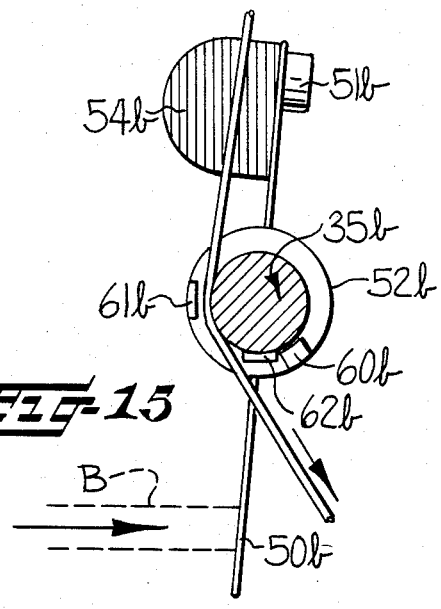
FIGS. 15 and 16 are end views of a strand interrupting apparatus in accordance with a third form of the invention, depicting the strand feeding and strand interrupting positions, respectively.
Figure 16:
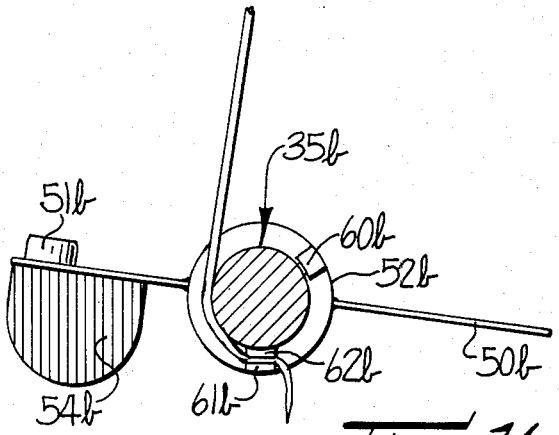
Figure 17:
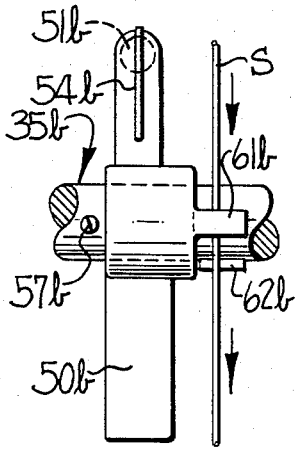
FIGS. 17 and 18 are front elevational views of the strand interrupting apparatus of FIG. 15, shown in the strand feeding and strand interrupting positions, respectively.
Figure 18:
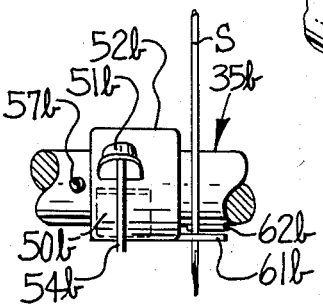
Figure 19:
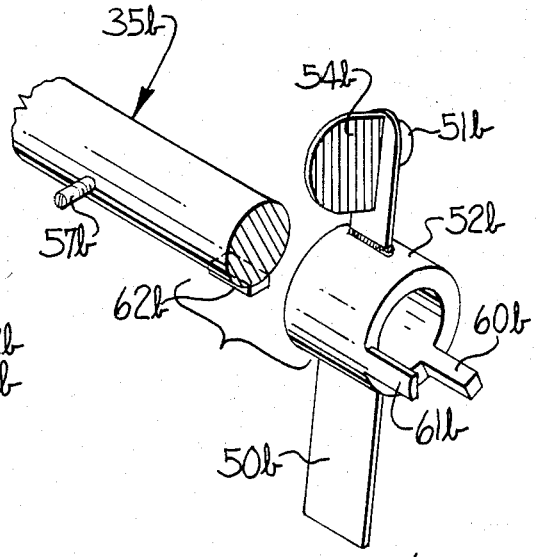
FIG. 19 is an exploded perspective view of the strand interrupting apparatus of FIG. 15.

During normal operation, the attenuated strand emerges from the drafting zone and is wound upon a spindle. This state of operation, known as "strand feeding" is represented in FIG. 6 by the solid lines and in FIG. 7. Note that as shown by FIG. 7, during operation in the strand feeding mode the longitudinal projection 53 is located longitudinally adjacent the strand.

When the supply strand breaks, supply strand interruption is required. Upon sensing of a broken strand by the traveling detector unit 13, an actuating signal B in the form of a burst of compressed air is directed toward target 50 and the force thereof in cooperation with weight 51 causes clockwise rotation of the collar about the elongate strand guide from the position indicated by the solid lines to the position shown by the dotted lines in FIG. 6 and generally shown in FIG. 8. During strand interruption, collar 52 rotates about the elongate strand guide as defined by arcoid slot 56 and limited by pin 57.

It will be noted that upon rotation, the collar travels longitudinally along the axis of the elongate strand guide in the path defined by the arcoid slot and cooperating pin so as to locate the longitudinal projection to overlie said feed strand and pinch it between the strand engaging surfaces.

A benefit thus obtained is that piece-up is simplified because the collar 52 may be moved laterally away from the strand engaging surface of the elongate strand guide. The strand is pinched between the strand engaging surfaces which are defined by the inner surface of the longitudinal projection 53 and the juncture of the hollow 40 with the outer surface of the elongate strand guide 35.

A further benefit derived from the above described invention is that the flag 54, upon actuation of the strand interruption apparatus moves from the position indicated by the solid lines out of line into the position indicated by the dotted lines. This out of line position (best illustrated in FIG. 3) enables the spinner to easily observe which drafting system is in an "ends down" state and is in need of "piece up."

Referring now to the second embodiment of the invention as illustrated in FIGS. 10–14, it will be noted that this embodiment of the invention is similar in many respects to the invention previously discussed in FIGS. 6–9. Accordingly, those parts shown in FIGS. 10–14 which correspond to similar parts shown in FIGS. 6–10 will bear the same reference characters to avoid repetitive description and only the differences in the target and weight members will be described in detail.

In this second arrangement, the supply strand S passes outwardly of the elongate strand guide thus accomplishing strand interruption on the outward portion of the strand engaging surfaces. The target 50*a* is attached via suitable means to the underside of the collar 52*a*, while the flag 54*a* and weight 51*a* are suitably attached opposite said target 50*a*. Actuating means B is directed toward target 50*a* which causes counterclockwise rotation of the collar about the elongate strand guide 35*a*. This rotation brings the projection 53*a* into proximate relation with the strand engaging surface of the strand guide so as to thereby pinch supply strand S. The flag is moved out of line into the lowered position indicated by the dotted lines in FIG. 11 to aid the spinner in locating a drafting system in the ends down state.

FIGS. 15 through 19 illustrate a third embodiment of the invention. In this instance, the collar 52*b* includes two longitudinal projections, one of thickness equal to the thickness of the collar and of length approximately one half the collar width, and a second projection having thickness approximately equal to one half the collar thickness and of length approximately one half the collar width (best shown in FIG. 19). These projections are separated by approximately 120 degrees along the collar circumference. The target 50*b* is suitably attached at a point on the collar's outer surface approximately equidistant between the two lateral projections. The flag 54*b* and weight 51*b* are located on the outer surface of the collar substantially opposite the target.

In this embodiment, the elongate strand guide consists of a round bar 35*b* including a suitably located longitudinally extending projection carried by the outer surface of the bars slightly less than one half the collar thickness, hereinafter termed an "anvil" 62*b*. This anvil acts as one of the strand engaging surfaces during interruption and serves along with pin 57*b* to longitudinally locate the collar 52*b*. In addition, the anvil cooperates with the two lateral projections 60*b*, 61*b* to limit the arc of rotation of the collar about the elongate strand guide. The collar 52*b* is mounted for operation such that the anvil 62*b* is located between the two lateral projections thereby defining its rotational path about the bar of approximately 120 degrees. The collar 52*b* is located longitudinally between the anvil 62*b* and the pin 57*b*. During normal operation, the supply strand moves along a path defined by the thin longitudinal projection 61*b* and the anvil 62*b* (see FIGS. 15 and 17). During strand interruption, the burst of air B is directed towards target 50*b*, which causes the collar 52*b* to rotate about said bar 35*b* to the position shown in FIGS. 16 and 18, thereby causing the strand to be pinched between the anvil 62*b* and the thinner longitudinal projection 61*b* thereby causing the supply strand S to break.

Figure 20:
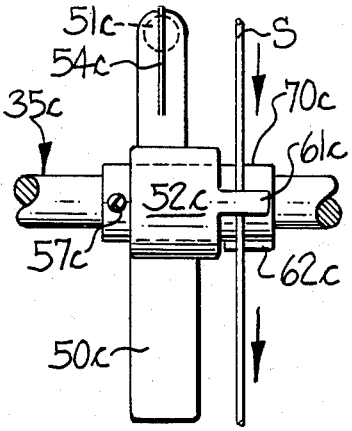
FIG. 20 is a front elevational view of a fourth embodiment of the strand interrupting apparatus in accordance with this invention.
Figure 21:
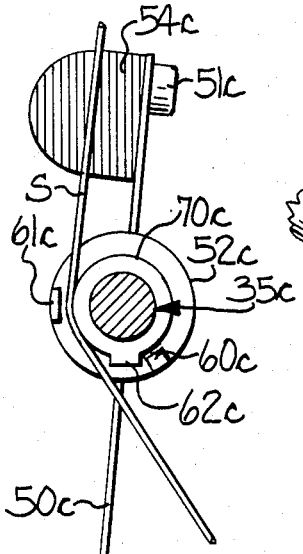
FIGS. 21 and 22 are end elevation and exploded views, respectively, of the strand interrupting apparatus of FIG. 20.
Figure 22:
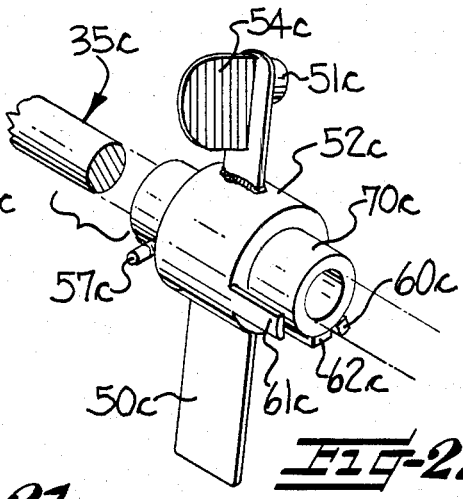

FIGS. 20–22 depict a fourth embodiment of the invention which is quite similar to the embodiment previously described except that a sleeve 70*c* has been added which surrounds the elongate strand guide 35*c*. Thus, the strand engaging surface is now located on the outer surface of sleeve 70*c*, rather than elongate strand guide 35*c*. The outer surface of sleeve 70*c* carries the anvil 62*c* and the locating pin 57*c*. The operation of this embodiment is essentially identical to the form of the invention illustrated in FIGS. 15–19. The pin 57*c* serves the dual functions of restricting the lateral movement of the collar and also serves to locate the entire strand interrupting apparatus along the longitudinal axis of the bar. The sleeve enables the strand interruption apparatus to be easily fitted, as the bar serves only a support function and does not act as a strand interrupting surface.

Figure 24:
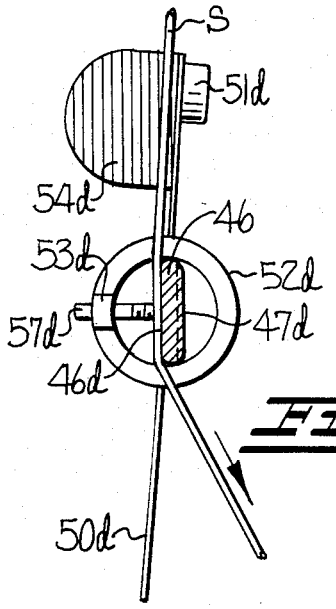
FIGS. 24 and 25 are end elevation views of the strand interrupting apparatus of FIG. 23, shown in the strand feeding and strand interrupting positions, respectively.
Figure 23:
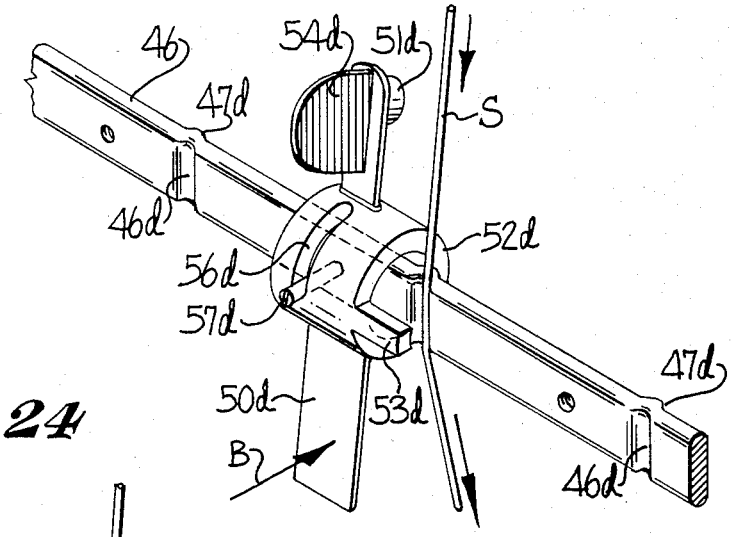
FIG. 23 is a perspective view of a fifth embodiment of the strand interrupting apparatus in accordance with this invention.
Figure 25:
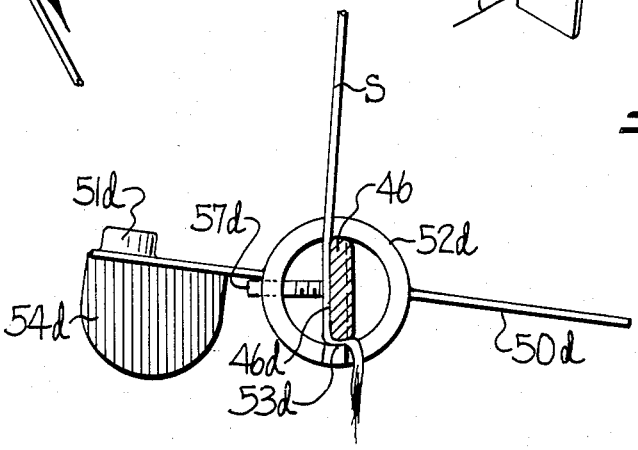

FIGS. 23–25 illustrate a fifth embodiment of the invention which includes a flat cross-sectional bar which serves as the elongate strand guide. This flat bar 46 includes stamped grooves which form a depression 46*d* on one side of said bar and a corresponding projection 47*d* on the opposite side spaced at distances appropriate for the spinning frame being fitted with the strand interrupting apparatus. These depressions serve as one of the strand engaging surfaces and collar 52*d* is mounted so as to position the single longitudinal projection 53*d* to overlie the groove 46*d*. The collar 52*d* includes a linear slot 56*d* in which a pin 57*d* is located, said pin serving the dual purpose of fixing the lateral position of the collar 52*d* and defining its rotational path. When the actuating burst of air B is received by the target 50*d*, the strand interruption apparatus moves from the strand feeding position (FIGS. 23 and 24) to the strand interruption position (FIG. 25).

Figure 26:
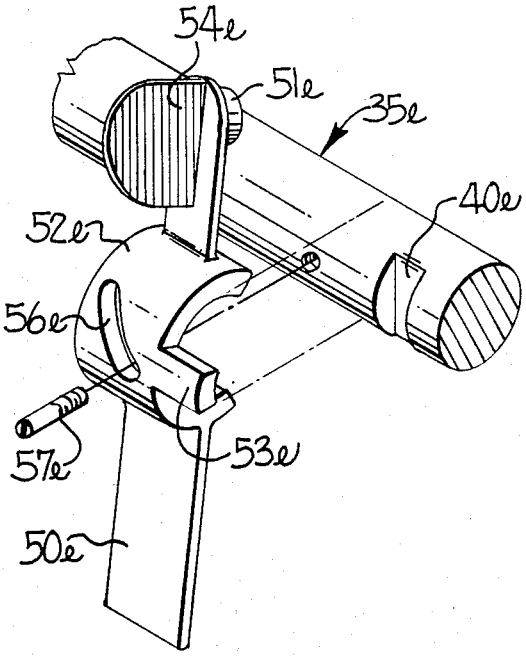
FIG. 26 is a perspective view of a sixth embodiment of the strand interrupting apparatus in accordance with this invention.
Figure 27:
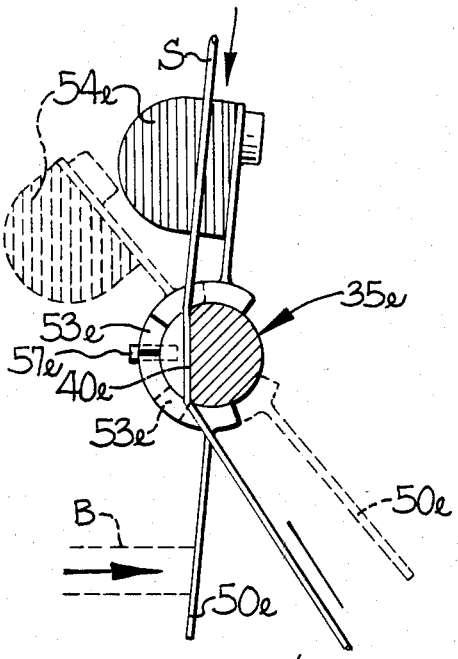
FIG. 27 is an end elevational view of the strand interrupting apparatus of FIG. 26 in the strand feeding and interrupting positions.

A sixth embodiment of the invention is illustrated in FIGS. 26–27. The operation is identical to the embodiment described in detail in FIGS. 10–14, the major difference being that the entire collar 52*e*, flag 54*e* and target 50*e* structure is one piece, and thus susceptible to mass production via a molding process. Furthermore, the collar is made of a material of sufficient flexibility to allow it to be flexed so that it snaps onto the elongate strand guide. The collar is slightly larger than semicircular, covering approximately 220 degrees of the outer surface of the bar, small enough to be clipped on, yet of sufficient circumference to enable the collar to be held in place on the elongate strand guide.

In summary, this invention is an apparatus to facilitate supply strand interruption to be used in conjunction with a spinning frame fitted with a traveling unit which senses a broken supply strand and supplies appropriate means to the strand interrupting apparatus to accomplish supply strand interruption. All of the previously described embodiments operate on the basic principle that during normal operation the supply strand is permitted to pass freely between a strand engaging surface provided on the elongate strand guide and a cooperating strand engaging surface provided on the collar, and when strand interruption is required, the collar rotates (in response to an appropriate actuating signal) to move the strand engaging surfaces into proximate relation to cause pinching of the supply strand and to thereby effect strand interruption.

In the drawings and specification there have been set forth preferred embodiments of the invention, and although specific terms are employed, they are used in a generic sense only and not for purposes of limitation.

That which is claimed is:

1. In the combination of a textile yarn spinning machine having a plurality of drafting units arranged in a series longitudinally of the spinning machine, a plurality of supply strand packages each normally delivering a corresponding supply strand to a corresponding drafting unit for producing a corresponding attenuated strand, means movable along the spinning machine and having detector means for monitoring production of attenuated strands and actuator means for responding to breakage of an attenuated strand, and strand interrupting means mounted on the spinning machine and selectively remotely actuable by the actuator means for interrupting feeding of the corresponding supply strand, an improvement in the strand interrupting means comprising:

means defining an elongate strand guide located between said supply strand packages and said drafting units and extending longitudinally past a plurality of successive drafting units, means associated with said strand guide means and defining respective strand engaging surfaces correspondingly positioned for cooperating with the respective supply strands, respective rotatably mounted collar means carried by said strand guide means, each including a strand engaging surface adapted to cooperate with the corresponding strand engaging surface associated with said strand guide means, said collar means being normally oriented in a strand feeding position with the strand engaging surface of the collar positioned in spaced apart relation from the cooperating strand engaging surface of said strand guide means for permitting the strand to pass freely therebetween, and said collar means being rotatably movable to a strand interrupting position in which the cooperating strand engaging surfaces are positioned in proximate relation for interrupting feeding of the supply strand passing therebetween, and means carried by said collar means and cooperating with said actuator means for effecting movement of said collar means from said strand feeding position to said strand interrupting position in response to actuation by said actuator means.

2. Apparatus according to claim 1 wherein said means defining an elongate strand guide comprises an elongate bar extending longitudinally of the spinning machine, and adjustable mounting means for mounting said elongate bar to the spinning machine to permit adjustment of the position of the bar both vertically and horizontally relative to said drafting units.

3. Apparatus according to claim 1 wherein said collar means is mounted for rotation about an axis extending longitudinally of the spinning machine, and wherein said collar means includes a projection extending parallel to and radially offset from the axis of rotation of the collar means, said strand engaging surface of the collar means being defined by said axially extending projection.

4. Apparatus according to claim 1 wherein said means defining an elongate strand guide comprises an elongate bar extending longitudinally past a plurality of successive drafting units, said bar including means defining respective hollow portions correspondingly positioned for the respective supply strands to pass thereover, and wherein said respective strand engaging surfaces associated with the strand guide means are defined by the juncture of the respective hollow portions with the outer surface of the bar.

5. In the combination of a textile yarn spinning machine having a plurality of drafting units arranged in a series longitudinally of the spinning machine, a plurality of supply strand packages each normally delivering a corresponding supply strand to a corresponding drafting unit for producing a corresponding attenuated strand, means movable along the spinning machine and having detector means for monitoring production of attenuated strands and actuator means for responding to breakage of an attenuated strand, and strand interrupting means mounted on the spinning machine and selectively remotely actuable by the actuator means for interrupting feeding of the corresponding supply strand, an improvement in the strand interrupting means comprising:

an elongate bar, means mounting said bar to said spinning machine between one of said supply strand packages and the corresponding drafting unit in such a position that the supply strand passes across the bar in its course of travel from the supply strand package to the drafting unit, collar means mounted for rotation about said bar, means associated with said bar and with said collar means and defining respective cooperating strand engaging surfaces, said collar means being normally oriented in a strand feeding position with the respective cooperating strand engaging surfaces positioned in spaced apart relation for permitting the strand to pass freely therebetween, and said collar being rotatably movable to a strand interrupting position in which the cooperating strand engaging surfaces are positioned in proximate relation for interrupting feeding of the supply strand passing therebetween, and means carried by said collar means and cooperating with said actuator means for effecting movement of said collar means from said strand feeding position to said strand interrupting position in response to actuation by said actuator means.

6. Apparatus according to claim 5 wherein said means mounting said bar to the spinning machine includes means for permitting adjustment of the position of the bar vertically and horizontally relative to said drafting unit.

7. Apparatus according to claim 5 wherein said collar means is mounted for rotation about the axis of said elongate bar, and wherein said means defining a strand engaging surface on said collar means comprises a projection extending parallel to the axis of said bar.

8. Apparatus according to claim 7 wherein said elongate bar includes means defining a hollow portion over which the supply strand passes when said collar means is in said strand feeding position, and wherein said strand engaging surface associated with the bar is defined by the juncture of said hollow portion with the outer surface of the bar.

9. Apparatus according to claim 8 wherein said hollow portion is in the form of a concave depression formed in the bar.

10. Apparatus according to claim 7 wherein said means defining a strand engaging surface on the bar comprises an axially extending projection carried by the outer surface of the bar and being positioned for cooperating engagement with the axially projecting portion on said collar means upon movement of the collar means into said strand interrupting position.

11. Apparatus according to claim 5 including a tubular sleeve mounted in surrounding relation to said bar, said collar means being rotatably mounted on said sleeve, and said sleeve including means defining a hollow portion over which the supply strand passes when said collar means is in said strand feeding position, and wherein said strand engaging surface associated with the bar is defined by the juncture of said hollow portion with the outer surface of said sleeve.

12. In the combination of a textile yarn spinning machine having a plurality of drafting units arranged in a series longitudinally of the spinning machine, a plurality of supply strand packages each normally delivering a corresponding supply strand to a corresponding drafting unit for producing a corresponding attenuated strand, means movable along the spinning machine and having detector means for monitoring production of attenuated strands and actuator means for responding to breakage of an attenuated strand, and strand interrupting means mounted on the spinning machine and selectively remotely actuable by the actuator means for interrupting feeding of the corresponding supply strand, an improvement in the strand interrupting means comprising:

an elongate bar located between said supply strand packages and said drafting units and extending longitudinally past a plurality of successive drafting units, means defining respective longitudinally spaced apart strand engaging surfaces associated with said elongate bar, the respective strand engaging surfaces being correspondingly positioned for cooperating with the respective supply strands, respective longitudinally spaced apart collar means carried by said elongate bar, and correspondingly positioned for cooperating with the respective supply strands, each of said collar means being independently mounted for rotation about the longitudinal axis of said elongate bar, and each including a projection extending parallel to the rotational axis of the collar means and defining a strand engaging surface adapted to cooperate with the corresponding strand engaging surface associated with said bar, said collar means including stop means operable for normally maintaining the collar means oriented in a strand feeding position with the respective cooperating strand engaging surfaces positioned in spaced apart relation for permitting the strand to pass freely therebetween, and said stop means being operable to permit said collar means to rotate to a strand interrupting position in which the cooperating strand engaging surfaces are positioned in contacting relation for interrupting feeding of the supply strand passing therebetween, and target means carried by said collar means and projecting therefrom to define a target surface cooperating with said actuator means, and being operable to effect movement of said collar means from said strand feeding position to said strand interrupting position in response to actuation by said actuator means.

* * * * *